US010306352B2

(12) United States Patent
Almeflo

(10) Patent No.: US 10,306,352 B2
(45) Date of Patent: May 28, 2019

(54) MICROPHONE HAVING CLOSED CELL FOAM BODY

(71) Applicant: 3M INNOVATIVE PROPERTIES COMPANY, St. Paul, MN (US)

(72) Inventor: Per Ove Almeflo, Ramlosa (SE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/039,501

(22) Filed: Sep. 27, 2013

(65) Prior Publication Data

US 2015/0092974 A1 Apr. 2, 2015

(51) Int. Cl.

| | |
|---|---|
| ***H04R 1/08*** | (2006.01) |
| ***H04R 1/28*** | (2006.01) |
| ***H04R 29/00*** | (2006.01) |
| ***H04R 25/00*** | (2006.01) |

(52) U.S. Cl.

CPC ..... *H04R 1/28* (2013.01); *H04R 1/083* (2013.01); *H04R 1/08* (2013.01); *H04R 29/004* (2013.01); *H04R 2217/00* (2013.01); *H04R 2217/01* (2013.01); *H04R 2217/03* (2013.01); *H04R 2410/07* (2013.01)

(58) Field of Classification Search

CPC ..... H04R 2217/00; H04R 2217/01; H04R 2217/03; H04R 1/28; H04R 1/083; H04R 1/08; H04R 29/004; H04R 2410/07

USPC ..... 381/190

See application file for complete search history.

(56) References Cited

U.S. PATENT DOCUMENTS

| | | | | |
|---|---|---|---|---|
| 3,403,234 | A | 9/1968 | Barnes | |
| 4,151,378 | A | 4/1979 | Watson | |
| 4,570,746 | A | 2/1986 | Das | |
| 5,446,788 | A * | 8/1995 | Lucey | H04M 1/05 379/430 |
| 5,574,794 | A | 11/1996 | Valley | |
| 5,808,243 | A | 9/1998 | McCormick | |
| 5,946,403 | A * | 8/1999 | Josephson | G06F 1/1605 381/122 |
| 5,988,585 | A | 11/1999 | Eaton | |
| 6,451,148 | B1 | 9/2002 | Jenner | |
| 6,587,564 | B1 * | 7/2003 | Cusson | 381/67 |
| 6,720,362 | B1 * | 4/2004 | Park | 521/79 |
| 7,783,069 | B1 | 8/2010 | Miller | |

(Continued)

FOREIGN PATENT DOCUMENTS

| | | |
|---|---|---|
| DE | 19742294 | 4/1999 |
| DE | 29711775 U1 | 4/1999 |

(Continued)

OTHER PUBLICATIONS

White et al., "The Audio Dictionary", Pop Filter, 3rd Edition, 2005, 5 pages.

(Continued)

*Primary Examiner* — Sean H Nguyen

(57) ABSTRACT

A microphone 10 that comprises a transducer 12 and a closed cell foam body 18, 20 positioned between the transducer 12 and an opening 25 fashioned for receiving ambient sound. The microphone 10 is protected from external factors without exhibiting substantial sound transmission loss while using few parts. Good voice transmission, wind buffeting mitigation, and environmental protection can be achieved with a single material.

20 Claims, 2 Drawing Sheets

(56) References Cited

U.S. PATENT DOCUMENTS

| | | | | |
|---|---|---|---|---|
| 8,401,217 | B2 | 3/2013 | Shams | |
| 8,739,926 | B1 | 6/2014 | Mori | |
| 2002/0025055 | A1* | 2/2002 | Stonikas et al. | 381/322 |
| 2003/0022955 | A1* | 1/2003 | Park et al. | 521/134 |
| 2004/0001945 | A1 | 1/2004 | Cate | |
| 2009/0046882 | A1* | 2/2009 | Sakurai | H04R 1/083 381/359 |
| 2009/0052699 | A1* | 2/2009 | Andersen | H04R 17/02 381/173 |
| 2010/0111345 | A1* | 5/2010 | Andrea | H04R 1/1083 381/359 |
| 2010/0150385 | A1* | 6/2010 | Sporer | 381/313 |
| 2011/0132095 | A1 | 6/2011 | Zuckerwar | |

FOREIGN PATENT DOCUMENTS

| | | |
|---|---|---|
| EP | 130400 | 4/1985 |
| EP | 0 711 881 | 5/1996 |
| EP | 2 925 014 | 9/2015 |
| GB | 2364463 | 1/2002 |
| WO | WO 2004/025988 | 3/2004 |
| WO | WO 2008/043385 | 4/2008 |
| WO | WO 2013/038915 | 3/2013 |
| WO | WO 2013/141158 | 9/2013 |

OTHER PUBLICATIONS

Viktorovich, Garanin Georgiy, Ultrasonic Stand of Control of Physical-Mechanical Properties of Metals and Alloys (On the Example of the Titan-Hydrogen System), Federal State Autonomous Education Institution, 2015.

* cited by examiner

MICROPHONE HAVING CLOSED CELL FOAM BODY

The present invention pertains to a microphone that has a transducer and a closed cell foam body located between the transducer and an area for receiving sound.

BACKGROUND

Microphones are commonly used to collect sound pressure variations from a sound source. Microphones commonly have a transducer to collect the sound, which is then sent to another device such as an amplifier or transmitter—see, for example U.S. Pat. No. 3,403,234. The transducer often is surrounded by a sound transmission media (STM). The STM represents an interface of the microphone with the ambient, acoustical environment. Sound pressure variation from speech, for example, must translate the STM to actuate the microphone transducer. A typical STM includes an open-cell foam material and a thin membrane—see, for example, U.S. Pat. No. 5,808,243 to McCormick et al. These parts reside between the transducer and the sound source. The foam provides mechanical and wind buffeting protection, while the membrane provides resistance to water or particulate intrusion. The thin membrane may be in the form of a thin polyethylene-terephthalate (PET) plastic film or similar material such as an acoustic polytetrafluoroethylene (PTFE) membrane, transparent for sound but closed for water. These thin membranes, however, represent a potential weak point in a microphone system. Being both thin and porous, they can be compromised mechanically and physically.

SUMMARY OF THE INVENTION

The present invention provides a microphone that comprises a transducer and a closed cell foam body positioned between the transducer and an area for receiving ambient sound. The present invention differs from known microphones in that the microphone uses a closed cell foam as the STM. As indicated above, conventional microphone products typically use an open cell foam material to protect the transducer. The present invention involves the discovery that a closed-cell foam may effectively protect the transducer without sound transmission loss from the sound source to the transducer. The present invention may allow an insertion loss of not greater than 10 dB/mm in the 300 to 3400 Hz frequency band when measured according to Insertion Loss Test Method described below. The invention also allows a microphone to be constructed which does not need an acoustic PTFE membrane to protect the transducer from being exposed to elements in the ambient environment. The microphone accordingly may be protected without substantial sound transmission loss, while using fewer parts than conventional products. Good voice transmission, wind buffeting mitigation, and environmental protection can be achieved without need for a membrane to provide particulate and water protection.

GLOSSARY

The terms set forth below will have the meanings as defined:

"closed cell" means that there are a series of discrete pockets or cells, each surrounded by a solid material;

"enclosed" means being surrounded the transducer from all directions and paths where sound can reach the surrounded item;

"foam" means a substance that has pockets of gas in a solid medium;

"insertion loss" means the difference between the signal levels in decibels (dB) with and without the device being tested in the transmission line;

"microphone" means a device that has an input for receiving energy in the form of sound at a first location and that converts the sound into another signal that is transmitted to a second location through an output on the device; and "transducer" means a device that converts acoustic sound into an electrical and/or optical signal.

DETAILED DESCRIPTION OF PREFERRED EMBODIMENTS

In practicing the present invention, a microphone is provided which comprises a transducer and a closed cell foam material positioned between the transducer and an opening for receiving ambient sound. The provision of a closed cell foam material so-positioned enables the transducer to be protected without use of a film membrane and with good sound transmission.

Figure 1:
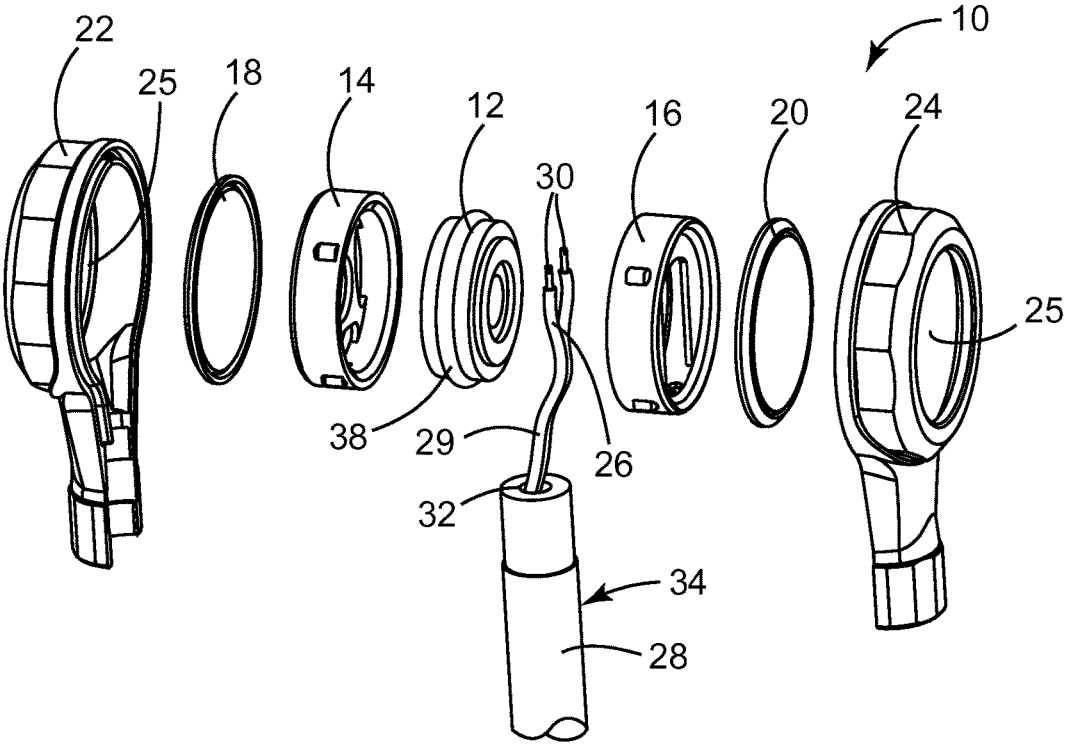
FIG. 1 shows a microphone 10 in accordance with the present invention in disassembled form.

FIG. 1 shows a microphone 10 as an assemblage that comprises a transducer 12, transducer support shells 14 and 16, closed-cell foam, sound-transmission elements 18 and 20, and outer containment body parts 22 and 24. The outer containment parts 22 and 24 include an area or opening 25 where sound may pass to reach the transducer 12. The sound-transmission elements 18 and 20 are located between the transducer 12 and the openings 25 in the outer containment parts 22 and 24. An electrical lead 26 is provided to deliver an output signal from the transducer 12 to a receiving device. The electrical lead 26 is housed in a conduit 28 through which wire 29 passes. The wire 29 includes conductive elements 30 that attach to the transducer 12. The conduit 28 has a sleeve 32 to accommodate passage of the wire 30 through it. The conduit 28 may be in the form of a boom arm 34 that supports the microphone 10. Although an electrical lead 26 and wire 30 are illustrated for use in delivering output signals to a receiving device, the microphone 10 may have, in lieu thereof, a wireless transmitter for sending output signals to a receiving device.

Figure 2:
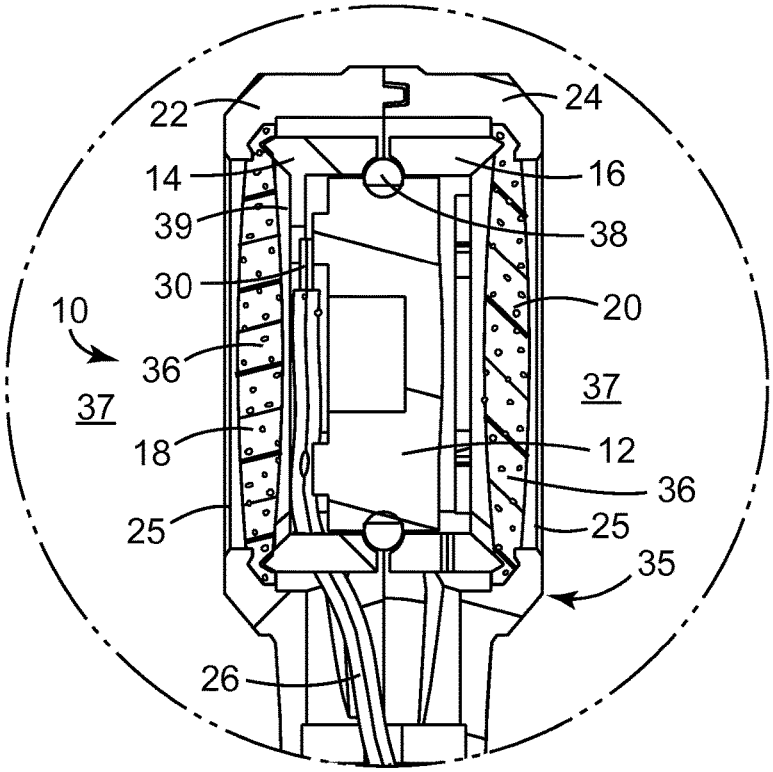
FIG. 2 shows the microphone 10 in accordance with the present invention in assembled condition.

FIG. 2 shows the head of the microphone 10 in an assembled condition where outer containment body parts 22 and 24 are joined together to form a housing 35. These parts 22 and 24 support the sound transmission elements 18 and 20 and the transducer 12 together with annular shells 14 and 16. The transducer 12 is further supported by support shells 14 and 16. Sound travelling from an external source must pass through the sound transmission elements 18 and 20 before reaching the transducer 12. The sound transmission elements 18 and 20 comprise a closed cell foam material 36 that is positioned between the transducer 12 and an area 37 for receiving ambient sound. The sound transmission elements 18 and 20 are located on opposing sides of the transducer 12, axially centered with respect to the openings 25 in the outer containment body parts 22 and 24. The closed-cell foam material 36 may surround the transducer 12 from all directions where sound waves can reach the transducer 12. At the transducer 12 the sound waves are converted to electrical signals that are transmitted to another device via the conductive elements 30 in the wire 29. The transducer 12 may have a diaphragm associated with it to receive sound pressure variations from the ambient environment. The output signals generated correspond to and are responsive to movement of the diaphragm. The transducer thus receives sound from ambient environment and supplies the signal (not necessarily of the same type) to a second component. The sound transmission elements 18 and 20 protect the transducer 12 from wind induced noise and physical elements present in the ambient environment such as moisture and water-based droplets. The transducer 12 includes an annular ring 38 that contributes to keeping the transducer 12 in proper alignment in the microphone housing 35. The housing 35 is constructed in a clam-shell configuration, with internal elements, such as the transducer 12 and first and second sound transmission elements 18 and 20, contained in the housing 35. The space between the foam 18, 20 and the transducer 12 creates an acoustic cavity 39. The cavity size may be optimized for signal level or for wind buffeting effect. The cavity typically occupies a volume of about 0.05 to 500 cubic centimeters ($cm^3$). The distance between the transducer and the closed cell foam may be tuned with the internal sound delay of the transducer for actual polar response. Typically the closed cell foam is spaced about 0.5 to 50 mm from the transducer. The housing size, the acoustic cavity, and the closed cell foam may be selected to achieve desired signal level and polar response.

Figure 3:
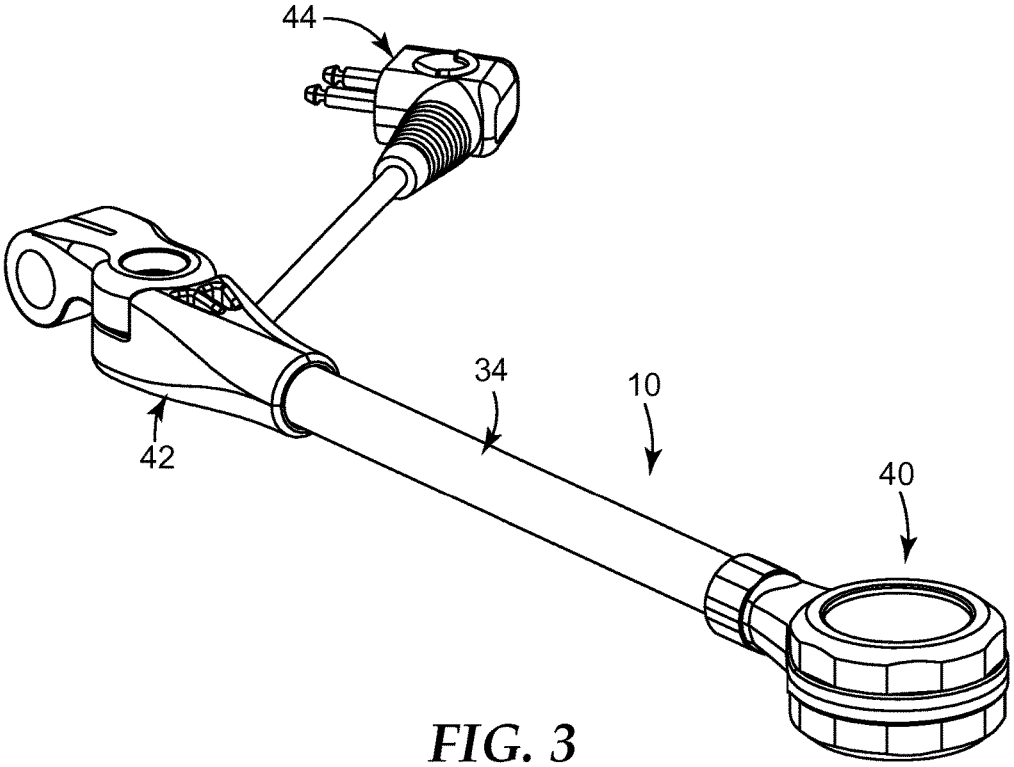
FIG. 3 shows the microphone 10 in accordance with the present invention connected to a boom 34.

FIG. 3 shows that the microphone head 40 of the microphone 10 may be placed in engagement with a boom arm 34. The boom arm 34 may be further placed in engagement with a pivotable member 42 that enables the user to place the microphone head 40 in a desired position relative to the sound source. The boom arm 34 may be manually deformable such as in a goose neck arm, or it may be restricted or pre-designed to have a linear or curved configuration to match the intended use of the microphone 10. The microphone 10 also may have an electrical fitting 44 that includes positive and negative conductive elements that enable the microphone 10 to be plugged into a corresponding female member, which then transmits the sound to a terminal device such as an external speaker, headphone, communication headset, or the like.

Figure 4:
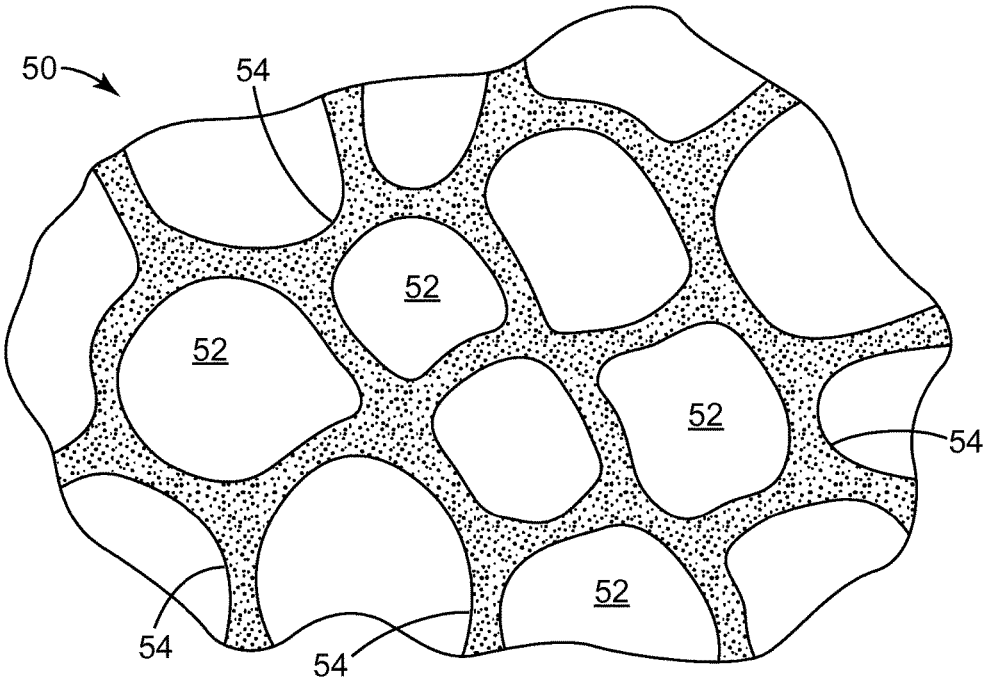
FIG. 4 is a cross-section of a closed cell foam material 50 that may be used in connection with the present invention.

FIG. 4 shows an example of a closed cell foam material 50 that may be used in a microphone of the present invention. The closed cell foam material 50 includes a series of discrete voids or cells 52 that are each completely surrounded by cellular walls 54. In contrast, an open cell foam material would have gas pockets or voids that connect with one another between the cellular walls or partial walls. The cells in the present invention 52 may have an average size of about 0.1 to 1 cubic millimeters ($mm^3$), more typically about 0.3 to 0.7 $mm^3$ The density of the closed cell foam material may be about 15 to 50 kilograms per cubic meter ($m^3$)($kg/m^3$), more typically 20 to 40 $kg/m^3$. Foam density may be measured according to ASTM D3575-91. The thickness of the closed cell foam may be about 1 to 10 mm thick, more commonly about 1.5 to 5 mm thick. Materials that may be used in closed cell foams of the present invention include polymers such as ethylene vinyl acetate (EVA), polypropylene, ethylene-propylene copolymer (EDPM), polyethylene, and polyvinylchloride (PVC). EVA has been found to be a particularly suitable material for use in the closed cell foam in microphones of the present invention. Examples of commercially-available closed cell foams that may be suitable for use in the present invention include EVASOTE™ crosslinked vinyl acetate (VA) copolymer foams. The crosslinked foams may be manufactured using pure nitrogen gas as a blowing agent. The foams may be in the form of rectangular or circular sheets that have process skins on all surfaces, particularly the outer major surfaces. The materials selected desirably enable the foam to pass the Environmental Test Method test set forth below. The closed cell foam that is used in the present invention exhibits a sound insertion loss of not greater than 10 decibels per millimeter (dB/mm) in the 300 to 3400 Hertz (Hz) frequency band when measured according to Insertion Loss Test Method set forth below; more typically the closed cell foam exhibits a insertion loss of not greater than 6 dB/mm in the 300 to 3400 Hz frequency; still more typically the closed cell foam exhibits a sound insertion loss of not greater than 3 dB/mm the 300 to 3400 Hz frequency band. A closed cell foam that exhibits a low insertion loss may be selected by choosing a closed cell foam material that has the density, cell size, thickness, and material composition that allows for a low insertion loss to be achieved. The closed cell foam may be disposed in a variety of locations between the transducer and the ambient sound source. It may be located within a housing into which the transducer is located; it may be located outside the housing, surrounding the microphone with the exception of the boom. The closed cell foam may be positioned to surround so much of the transducer to serve its intended function of buffering unwanted noise and protecting the transducer. In many embodiments, the whole transducer may be enclosed by the closed cell foam. The foam may be placed in sheet-like form supported by a frame, or it may be in block form, with a space for receiving the transducer or microphone head.

EXAMPLE

Test Methods

Insertion Loss Test Method

To evaluate insertion loss of a closed cell foam STM element, an 18 mm diameter section of foam was mounted in a sample holder that had a standard pressure microphone located behind the foam. The holder was configured to have the same size, and used material similar to the housing, of the microphone being measured. Only the front side of the foam was exposed to sound transmission: the backside of the holder had the sound inlet closed. Behind the closed cell foam, and in front of the pressure microphone, there was a cavity that had a size of 0.25 $cm^3$, the same size as the acoustic cavity in the microphone housing having the STM element being measured.

The assembly was placed in an acoustic chamber that had an inside volume of approximately 6 cubic meters ($m^3$). A measurement system, which was capable of generating and recording acoustic signals, both in time and in frequency, was used to capture the signal from the microphone both with and without the closed cell foam. A pink noise sound source that had equal energy in all 1/12 octave band was used to generate the test signal. Insertion loss was then calculated as the difference between the signal with and without the mounted foam for the frequency band of 300 Hz to 3400 Hz.

Environmental Test Method

An environmental test is conducted by submerging a microphone assembly in a 5% salt solution of water for 1 hour at room temperature (approximate 22° C.). Any intrusion of the salt solution past the STM is noted as a failure. Re-measurement of the microphone performance may be conducted after all visible water drops are removed from the exterior of the housing; the microphone should then perform equal to its performance before the water submerging step.

Example 1

An all-weather voice communication boom microphone assembly that was similar to the illustrated embodiment and that housed a microphone transducer was assembled as follows. A microphone assembly was created, which had three interconnected parts: a microphone head, a boom arm, and a device holder. The microphone head contained several elements: a transducer, transducer support shells, and a closed-cell foam STM. The outer containment body of the microphone head enclosed the voice transmission elements and attached the microphone head to the boom arm. Electrical leads were connected to the transducer and were passed through the boom arm to the electrical fitting. The boom arm both supported the microphone head and the electrical leads 23 and further provided and electrical connection to a communication headset. The boom arm was 154 mm long and was 6 mm in diameter and was constructed as a typical microphone gooseneck arm. The boom arm was flexible for positioning the boom head. The microphone head was attached to the boom arm at one end in sealed fashion.

The transducer was a OWMSCDY-13843T-71-150 from OLE WOLFF ELEKTRONIK A/S located at Roedengvej 25 4180 Soroe Denmark. The transducer had a 13.8 mm diameter and had a dynamic hypercardioid microphone capsule. Situated in the microphone head, the transducer was protected on both the front and rear sides by an EV30 closed cell foam of the EVASOTE™ series. The closed-cell foam had an internal cell size of 0.45 mm and was made from a cross-linked, ethylene-vinyl-acetate (EVA) copolymer manufactured by Zotefoams PLC, 675 Mitcham Road, Croydon CR9 3AL United Kingdom. The foam was 2 mm thick and had a diameter of 18 mm.

The outer containment body parts of the microphone head were produced in a plastic three-dimensional (3D) prototype printer that had a diameter of 22 mm and, as assembled, had a front to back distance of 12 mm. When assembled, the outer containment body of the microphone head clamped the transducer in the O-ring, support shells, and the closed cell foam parts into axial centricity with the windows of the outer containment body parts. The unit housing and positioning of the transducer and closed cell foam therein provided an acoustic cavity volume between the transducer and the closed cell foam of approximately 0.25 $cm^3$.

The microphone assembly of the present example was tested in accordance with the Insertion Loss Test Method and was also submitted to a liquid intrusion test as described in the Environmental Test Method. Insertion loss for the 2 mm thick EV30 closed cell foam was determined to be 3 dB, well within functional parameters needed for suitable voice transmission. When submitted to environmental testing, the microphone passed: there was no evidence of liquid intrusion beyond the closed cell foam.

This invention may take on various modifications and alterations without departing from its spirit and scope. Accordingly, this invention is not limited to the above-described but is to be controlled by the limitations set forth in the following claims and any equivalents thereof.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A microphone that comprises:

(a) a transducer; and (b) a closed cell foam material positioned between the transducer and an area for receiving ambient sound, such that the closed cell foam material encloses the transducer, and the closed cell foam material is planar-shaped as positioned between the transducer and an opening of a housing through which the ambient sound passes to reach the transducer, wherein the microphone comprises the housing;

wherein the closed cell foam exhibits an insertion loss of not greater than 10 dB/mm in the 300 Hz to 3400 Hz frequency band when measured according to the Insertion Loss Test Method.

2. The microphone of claim 1, wherein the closed cell foam exhibits an insertion loss of not greater than 6 dB/mm the 300 Hz to 3400 Hz frequency band when measured according to Insertion Loss Test Method.

3. The microphone of claim 2, wherein the closed cell foam exhibits an insertion loss of not greater than 3 dB/mm the 300 Hz to 3400 Hz frequency band when measured according to Insertion Loss Test Method.

4. The microphone of claim 1, further comprising:

(c) a housing into which the transducer is mounted.

5. The microphone of claim 4, further comprising:

d) a boom attached to the housing.

6. The microphone of claim 5, wherein the boom includes a conduit that engages the housing and that contains a wire that transmits signals from the transducer to another device.

7. The microphone of claim 6, wherein the closed cell foam body surrounds the housing and has an opening for the boom to pass therethrough.

8. The microphone of claim 4, wherein there is an acoustic cavity located between the transducer and the closed cell foam.

9. The microphone of claim 8, wherein the acoustic cavity has a volume of 0.05 $cm^3$ to 500 $cm^3$.

10. The microphone of claim 8, wherein the closed cell foam is spaced about 0.5 mm to 50 mm from the transducer.

11. The microphone of claim 4, wherein the closed cell foam has an average cell size of 0.1 $mm^3$ to 1 $mm^3$.

12. The microphone of claim 4, wherein the closed cell foam has an average cell size of 0.3 $mm^3$ to 0.7 $mm^3$.

13. The microphone of claim 4, wherein the foam has a density of 15 $kg/m^3$ to 50 $kg/m^3$.

14. The microphone of claim 4, wherein the foam has a density of 20 $kg/m^3$ to 40 $kg/m^3$.

15. The microphone of claim 4, wherein the foam has a thickness of 1 mm to 10 mm.

16. The microphone of claim 4, wherein the foam has a thickness of 1.5 mm to 5 mm.

17. The microphone of claim 13, wherein the closed cell foam comprises a polymer selected from the group consisting of ethylene vinyl acetate, polypropylene, ethylene-propylene copolymer, polyethylene, and polyvinylchloride.

18. The microphone of claim 1, wherein a planar surface of the closed cell foam material is orthogonal to an axis, and the axis also passes orthogonally through a plane parallel with the opening of the housing.

19. A microphone that comprises:

(a) a transducer;

(b) a closed cell foam material positioned between the transducer and an area for receiving ambient sound, wherein the closed cell foam material is planar-shaped, such that the closed cell foam material encloses the transducer, the closed cell foam having a density of 15 $kg/m^3$ to 50 $kg/m^3$ and exhibits an insertion loss of not greater than 6 dB/mm in the 300 Hz to 3400 Hz frequency band when measured according to Insertion Loss Test Method;

(c) a housing into which the transducer is mounted, and the closed cell foam material is planar-shaped as positioned between the transducer and an opening of the housing through which the ambient sound passes to reach the transducer; and (d) an acoustic cavity disposed between the closed cell foam and the transducer.

20. The microphone of claim 19, wherein a planar surface of the closed cell foam material is orthogonal to an axis, and the axis also passes orthogonally through a plane parallel with the opening of the housing.

* * * * *